United States Patent [19]

Ryaa et al.

[11] Patent Number: 4,988,324

[45] Date of Patent: Jan. 29, 1991

[54] TOY FIGURE WITH BALL AND SOCKET JOINT

[75] Inventors: Jan Ryaa, Billund; Ole Poulsen, Vejle, both of Denmark

[73] Assignee: Interlego A.G., Baar, Switzerland

[21] Appl. No.: 414,613

[22] Filed: Sep. 26, 1989

Related U.S. Application Data

[63] Continuation of Ser. No. 84,792, filed as PCT DK86/00130 on Dec. 3, 1986, published as WO87/03502 on Jun. 18, 1987, abandoned.

[30] Foreign Application Priority Data

Dec. 4, 1985 [DK] Denmark ..... 5608/85

[51] Int. Cl.[5] ..... A63H 3/46; A63H 3/16; F16C 11/06

[52] U.S. Cl. ..... 446/383; 446/100; 403/114

[58] Field of Search ..... 446/97, 99, 100, 383, 446/378, 376, 382; 403/114, 115; 24/324, 662; 623/18, 20, 47, 53

[56] References Cited

U.S. PATENT DOCUMENTS

| | | | |
|---|---|---|---|
| 2,752,726 | 7/1956 | Calverly | 446/99 |
| 3,638,243 | 2/1972 | Campbell, Jr. et al. | 623/20 |
| 3,805,302 | 4/1974 | Mathys | 446/376 X |
| 3,837,008 | 9/1974 | Bahler et al. | 446/376 X |
| 3,955,311 | 5/1976 | Lyons et al. | 446/383 X |
| 4,673,374 | 6/1987 | Kelley | 446/383 |
| 4,790,789 | 12/1988 | Mathis | 446/383 X |

FOREIGN PATENT DOCUMENTS

| | | | |
|---|---|---|---|
| 3302995 | 8/1984 | Fed. Rep. of Germany | 446/383 |
| 2556791 | 6/1985 | France | 446/120 |
| 55744 | 6/1935 | Netherlands | 446/383 |
| 854666 | 11/1960 | United Kingdom | 24/662 |

*Primary Examiner*—Robert A. Hafer
*Assistant Examiner*—D. Neal Muir
*Attorney, Agent, or Firm*—Kane, Dalsimer, Sullivan, Kurucz, Levy, Eisele and Richard

[57] ABSTRACT

In a toy figure with body parts movable in various directions the body parts (in the embodiment shown the legs) are connected with the body in a manner known per se by means of a socket (13) designed to receive a ball (6). To ensure long-term frictional stability between the movable parts, the body part (9) is formed with a pair of opposed walls (10,11) designed to squeeze an engagement face (7) which is contiguous with the ball (6 1).

4 Claims, 1 Drawing Sheet

TOY FIGURE WITH BALL AND SOCKET JOINT

This is a continuation of co-pending application Ser. No. 084,792, filed as PCT DK86/00130 on Dec. 3, 1986, published as WO87/03502 on Jun. 18, 1987 now abandoned.

BACKGROUND OF THE INVENTION

The invention concerns a toy figure having movable body parts, where the joint between two mutually movably connected body parts comprises a ball at the end of a pin protruding from one body part, and where the other body part has a depression with a socket to receive the pin so that the ball engages the socket. A toy figure of this type is known e.g. from the U.S. Pat. Specification No. 1 868 049. This prior art, like later known attempts at constructing movable joints on toy figures, is vitiated by the drawback that the mobility appears to be "loose-jointed". More particularly, there is no limit to the possible movements so that the limbs may easily assume all possible positions, and the friction, which might be intended for retaining the body parts in a specific position with respect to the body, disappears rapidly because of wear. Therefore, the toy figure rapidly becomes unable to serve its purpose, i.e. to stay in a given position with some mutual friction between the movable parts.

The object of the invention is to provide a toy figure of the present type, which eliminates the above-mentioned drawbacks.

SUMMARY OF THE INVENTION

This object is achieved in that the toy figure is constructed as stated in the characterizing portion of claim 1, since the mentioned opposed walls serve as guide faces for the motion of the body part and also elastically squeeze the said engagement face so that a constant friction is maintained. This results in a toy figure with a well-defined mobility of the body parts, but also a languid mobility so that the toy figure can remain in a fixed position, also after an extended period of time. The technical effect described has especially relation to the hip joint structure, and the embodiment described below actually relates to an embodiment of the hip joint structure.

Claim 2 defines preferred details in an embodiment where the diameter of the thickened portion is preferably larger than the diameter of the ball, providing for easier assembly of the components.

The features defined in claim 3 enable the body part to be moved close to the body itself. Claim 4 defines a preferred way of keeping the ball in position in the socket.

BRIEF DESCRIPTION OF THE DRAWINGS

The invention will be explained more fully by the following description of an embodiment with reference to the drawing, in which.

DETAILED DESCRIPTION OF THE PREFERRED EMBODIMENT

Figure 1:
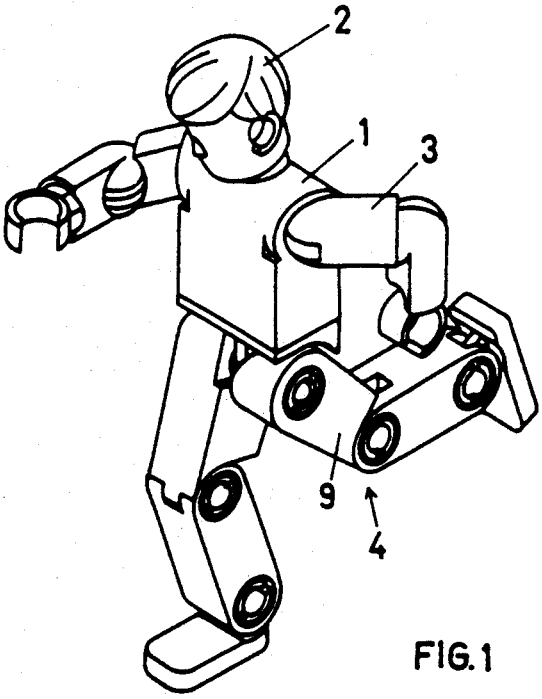
FIG. 1 is a perspective view of an embodiment of the toy figure of the invention.
Figure 2:
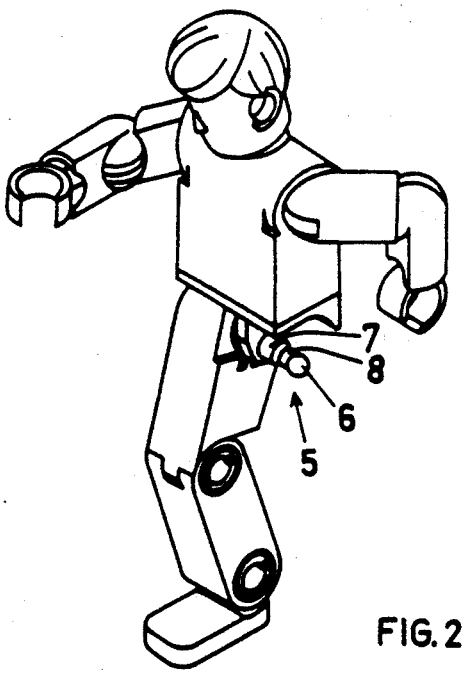
FIG. 2 shows the same as FIG. 1, but with the left leg removed so that the hip joint ball is visible.

The toy figure shown in FIG. 1 comprises a body 1, on which a head 2, arms 3, legs 4 are secured. These body parts are rotatably secured on the body 1, and in the shown embodiment the hip joint is constructed in accordance with the invention. FIG. 2 shows that the hip structure comprises a pin 5 which protrudes from the body and has a ball 6 at the end. The pin 5 moreover comprises a cylindrical portion 7 which serves as an engagement face and has a larger diameter than the size of the ball 6, and an area 8 of reduced diameter is provided between the engagement face 7 and the ball 6.

Figure 3:
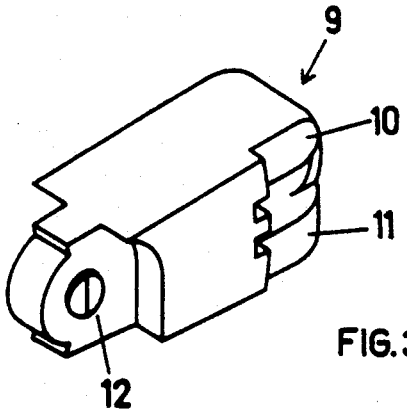
FIG. 3 is a perspective view of the inner side of a thigh.
Figure 4:
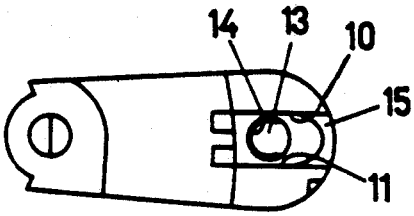
FIG. 4 shows the thigh of FIG. 3, as viewed toward the inner side.
Figure 5:
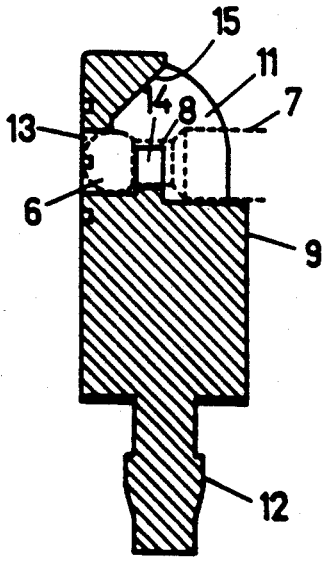
FIG. 5 is a section through the embodiment of the hip joint structure of the invention.

FIG. 3 shows in perspective a thigh 9 which, according to the invention, has a pair of protruding, opposed walls 10, 11 with a curved outer edge (see FIG. 5). The opposite end of the thigh in FIG. 3 is formed with a knee link structure 12, which will not be described in detail. FIG. 4 shows the thigh of FIG. 3 from the inner side, and moreover shows a hole 13 to receive the ball 6 and a semi-circular bead 14 which will be explained more fully in connection with FIG. 5.

FIG. 5 is a section through the thigh 9 shown in FIGS. 3 and 4. The wall 11 and its curved outer edge are clearly visible in FIG. 5, which moreover shows in broken lines the position of the hip joint ball from FIG. 2. Thus, it will be seen clearly how the hip joint ball is received in the hole 13, and it will be understood how an additional engagement for the movable parts has been provided in that the inner side of the wall 11 (and the opposite side from the wall 10) engages the cylindrical engagement face 7 with the predetermined elastic force, so that the leg can assume suitably fixed positions with respect to the body. Further the bead 14 explained in connection with FIG. 4 is clearly visible in FIG. 5, said bead being disposed opposite the portion of the pin 8 which has a reduced diameter, so that the ball 6 cannot fall out of the hole 13. Thus, the leg can be pivoted forwardly and rearwardly and can moreover be lifted to the side, said movement being restricted by an inclined wall 15 which is also visible in FIG. 4.

What is claimed:

1. In a toy figure having movable body parts including a joint between two mutually movably connected body parts, said joint comprising a ball at an end of a pin protruding from one body part and a depression including a socket to receive said ball on the other body part, the improvement wherein said pin further includes a rod spaced apart from said ball and disposed between said one body part and said ball, the outer surface of said rod defining an engagement face, and said depression further includes a pair of opposed walls spaced apart a distance slightly less than the cross sectional dimension of said rod so that the engagement face is squeezed between the walls when the body parts are interconnected.

2. A toy figure according to claim 1, characterized in that the engagement face (7) for said opposed walls (10, 11) is a cylindrical thickened portion of the pin (5).

3. A toy figure according to claim 1 or 2, characterized in that edges of the opposed walls facing said one body part (1) are curved with the centers of curvature in the vicinity of the socket (13).

4. A toy figure according to claim 1 or 2, characterized by a semi-circular bead (14) interposed between the socket (13) and the opposed walls (10, 11) opposite the pin portion disposed between the ball (6) and the engagement face (7).

* * * * *